US005881892A

United States Patent [19]

Loo

[11] Patent Number: 5,881,892

[45] Date of Patent: Mar. 16, 1999

[54] DISPLAY RACK

[75] Inventor: Bruno Van Loo, Hillegom, Netherlands

[73] Assignee: Simple Pleasures Flowerbulbs & Perennials, Inc., Babylon, N.Y.

[21] Appl. No.: 940,482

[22] Filed: Sep. 30, 1997

[51] Int. Cl.[6] ..... A47F 5/00

[52] U.S. Cl. ..... 211/133.3; 211/133.1; 211/126.5; 211/126.13

[58] Field of Search ..... 211/126.1, 133.1, 211/133.3, 195, 126.5, 126.13, 132.1, 126.6, 204

[56] References Cited

U.S. PATENT DOCUMENTS

| | | | |
|---|---|---|---|
| 240,807 | 5/1881 | Beneke | 211/195 |
| 1,240,908 | 9/1917 | Weis et al. . | |
| 1,446,036 | 2/1923 | Dodd . | |
| 1,666,622 | 4/1928 | Hess | 211/204 X |
| 2,192,102 | 2/1940 | Pinto | 211/133.3 |
| 3,181,703 | 5/1965 | Dunham . | |
| 4,228,906 | 10/1980 | Jones . | |
| 4,377,241 | 3/1983 | Schreiner | 211/133.3 |
| 4,586,618 | 5/1986 | Norman | 21/133.3 |
| 5,000,326 | 3/1991 | Vaughn | 211/41.11 |

*Primary Examiner*—Robert W. Gibson, Jr.

*Attorney, Agent, or Firm*—Collard & Roe, P.C.

[57] ABSTRACT

A display rack for displaying storage boxes for merchandise, comprising two vertical, spaced apart members attached to two horizontal base portions. Each vertical member has a slit cut in its top end for insertion of a sign. Each base portion has a slot cut therethrough on one side, so that the bottom end of a vertical member fits within the slot. There is also means for securing each base portion to a vertical member so that the vertical members slant slightly rearwardly from the vertical. Each base portion can be rotated to lie parallel with the vertical member to which it is secured. A plurality of spaced-apart horizontal beams are mounted between the two vertical members and attached to the rear side of each of the two vertical members. A plurality of spaced-apart horizontal support means are also mounted between the vertical members and beneath a corresponding horizontal beam, so that the distance between a horizontal support means and the corresponding horizontal beam is equal to the height of the box. The storage box can be detachably mounted on the rack by placing the rear wall of the box a behind a beam so that the rear wall of the box rests against the beam. The bottom of the box then rests on the support means, so that the bottom of the box is angled slightly downward from horizontal to display the merchandise contained therein.

8 Claims, 2 Drawing Sheets

DISPLAY RACK

BACKGROUND OF THE INVENTION

1. Field of the Invention

This invention relates to a display rack for stackable boxes. In particular, this invention relates to a vertical, free-standing display rack that is adapted for attachment to boxes of flower bulbs or other products to display such boxes.

2. The Prior Art

Free-standing racks are commonly used in the retail industry to display various items for sale. These racks often comprise a series of horizontal bars connected by two vertical members that are mounted on a base. The items may be either hung directly on the racks, or placed in boxes or trays which are hung on the racks via hooks or pegs.

Often a bracket is mounted on the bars which is capable of mounting a storage box for display of merchandise. An example of such a display mechanism is shown in U.S. Pat. No. 4,228,906 to Jones, which shows an upright adjustable rail mounting assembly having flanges located on horizontal rails. Storage boxes are equipped with hooks which facilitate attaching the boxes to the flanged rails.

Another type of display system is shown in U.S. Pat. No. 3,181,703 to Dunham, which discloses a vertical display rack having a plurality of horizontal brackets mounted thereon. Storage boxes are mounted on the display rack by placing the rear wall of the box underneath the upper flange of the bracket and resting the bottom of the box on the bottom flange of the bracket.

Additional display systems are shown in U.S. Pat. No. 1,240,908 to Weis et al., and U.S. Pat. No. 1,446,036 to Dodd. These systems also show the mounting of storage boxes onto brackets for display on vertical racks.

While all of these systems are useful for displaying merchandise, they all suffer from drawbacks. First, it would be desirable to construct a display rack that does not require the use of many extra components, such as brackets, screws, etc., which must be attached to either the rack or the storage box before the box can be mounted. Second, it would also be desirable to construct a display rack whose base can be folded so that the rack lies completely flat for ease of transportation. Third, it would also be desirable to have a means for mounting a sign on the rack, to advertise the merchandise being displayed. Fourth, purely vertical display racks do not optimize the display capabilities of the storage boxes. A rack that is inclined slightly rearwardly from the consumer best displays the merchandise contained in the hanging storage boxes, and is better balanced than a purely vertical rack.

SUMMARY OF THE INVENTION

It is therefore an object of the present invention to provide a display rack for displaying storage boxes of merchandise that is capable of mounting the storage boxes without the use of brackets or hooks.

It is another object of the present invention to provide a display rack that can be folded flat for ease of shipping.

It is yet another object of the present invention to provide a display rack that is capable of receiving a sign for advertising the merchandise being displayed.

It is a further object of the present invention to provide a display rack that is angled away from the vertical to provide an optimum angle for displaying merchandise in hanging storage boxes, and to better balance the rack when the storage boxes are full.

These and other objects of the invention are accomplished by a display rack for displaying storage boxes for merchandise, comprising two upright vertical, spaced apart members attached to two horizontal base portions. Each vertical member has a slit cut in its top end for insertion of a sign for advertising the products being displayed.

Each base portion has a slot cut therethrough on one side, so that the bottom end of a vertical member fits within the slot. The slot is the exact width of the vertical members so that the vertical members fit snugly within the slots. The slots are cut at an angle so that the vertical members slant slightly rearwardly from the vertical. Means are provided for securing the base portions to the vertical members. Each base portion can be rotated to lie parallel with the vertical member to which it is secured.

A plurality of spaced-apart horizontal beams are mounted between the two vertical members and attached to the rear side of each of the two vertical members.

A plurality of spaced-apart horizontal support means are also mounted between the vertical members and beneath a corresponding horizontal beam, so that the distance between a horizontal support means and the corresponding horizontal beam is equal to the height of the box. The storage box can be detachably mounted on the rack by placing the rear wall of the box behind the beam so that the rear wall of the box rests against the beam. The bottom of the box then rests on the support means, so that the bottom of the box is angled slightly downward from horizontal to display the merchandise contained therein. The box preferably has slits in it side walls for accommodating the beam.

Preferably, there are four horizontal beams and four pairs of support means, so that four tiers of boxes can be mounted for display. There is also preferably room for at least two, and preferably four storage boxes to be mounted on each horizontal beam.

The means for securing each base portion to a vertical member preferably comprises a screw and wing-nut. Loosening the wing-nut allows the base portion to be rotated between a horizontal position, in which the vertical member is securely fit in the slot in the base member, and a vertical position, which makes the entire device lay flat for ease of shipping.

The support means preferably comprises a pair of support bars, one bar being mounted on the front side of the vertical members and the other bar being mounted at a slightly higher height on the rear side of the vertical members. This way, the rear portion of the bottom of the box rests on the rear support bar and the front portion of the bottom of the box rests on the front support bar, so that the box is angled slightly downwardly from the horizontal for optimum viewing.

This type of display rack is ideal for displaying boxes of flower bulbs, because the angle of the rack and of the boxes lets the customer have good view of the bulbs stored in the box, even if several tiers of boxes are being displayed. In addition, the slight rearward slant of the rack ensures stability of the rack both when it is bare and when mounted with full boxes. The larger and heavier the boxes, the greater degree of slant is required. Preferably, the degree of slant is between 10° and 30° off the vertical.

The boxes are also easy to exchange for other boxes when all of the bulbs in a box are sold. The rack does not require the use of any special hardware on the storage boxes, so the boxes can be made of cardboard, paperboard or any other inexpensive material, and can thus be disposable. This feature is particularly important in the display of plant products, because the soil and moisture can detract from the appearance of the storage box over time.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 2:
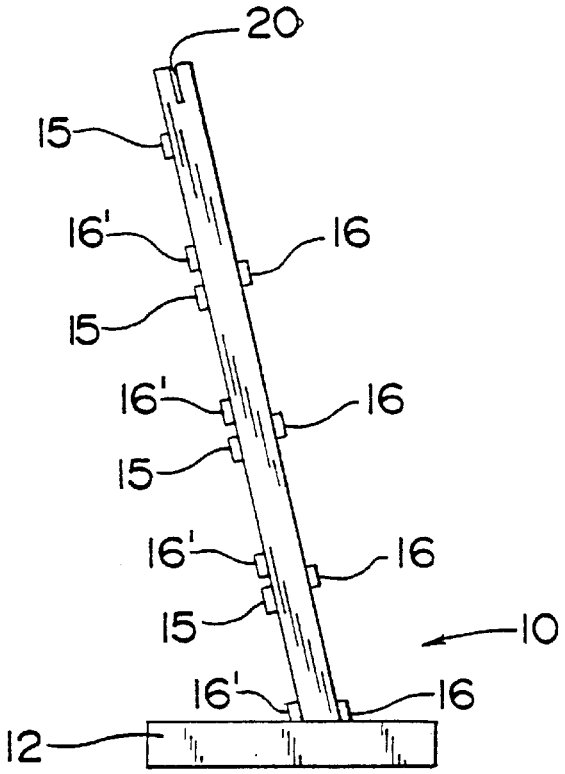
FIG. 2 shows a side view of the display rack according to the invention.
Figure 1:
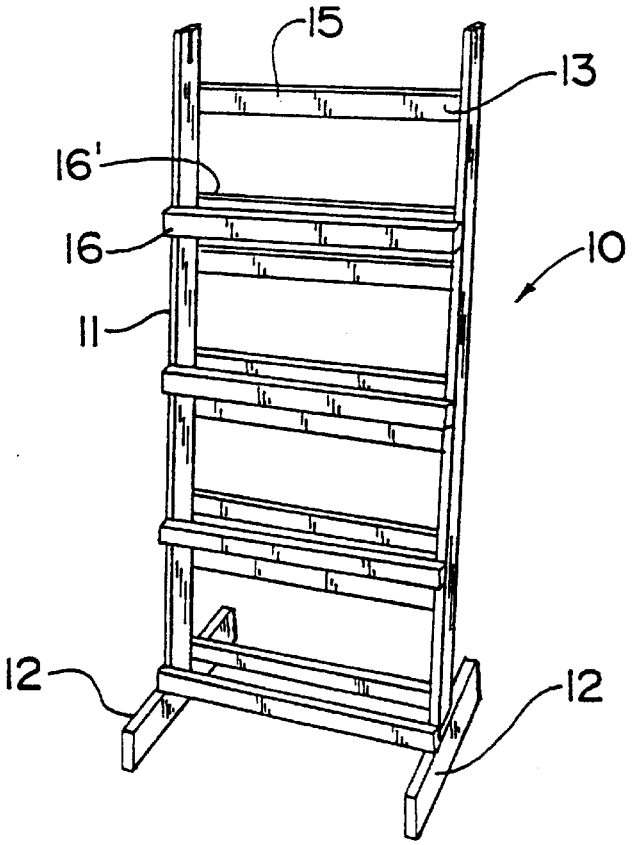
FIG. 1 shows a perspective view of the display rack according to the invention.

Turning now in detail to the drawings, and in particular, FIGS. 1 and 2, there is shown a display rack 10 according to the invention, comprised of two vertical members 11, each attached to a base portion 12. As shown in FIG. 2, vertical members 11 are mounted so that they are slanted slightly backward from the vertical. This angle creates an optimal display angle for the boxes of merchandise mounted thereon, and ensures stability of the rack by ensuring that the center gravity of the rack, even when equipped with heavy cantilevered boxes, is always over the horizontal base portions 12.

A plurality of horizontal beams 15 are mounted between vertical members 11, and are attached at the rear side of vertical members 11.

A plurality of support bars 16 and 16' are mounted between vertical members 11. Each bar 16 is mounted on the front face of vertical members 11, and has a corresponding bar 16' mounted on the rear face of vertical members 11. Bar 16' is arranged to be slightly higher than bar 16, so that a storage box that is mounted on rack 10 will be angled slightly downward.

Figure 3:
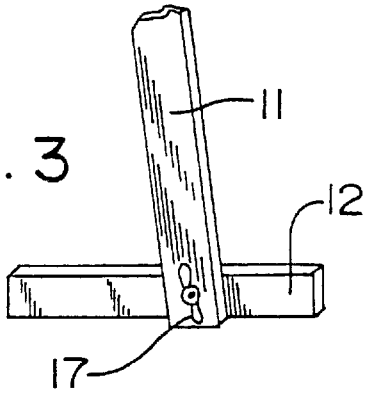
FIG. 3 shows a side perspective view of the base and one vertical member of the display rack according to the invention.
Figure 4:
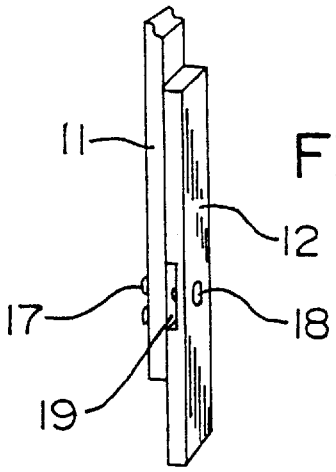
FIG. 4 shows a side perspective view of the base and vertical member according to FIG. 3 in the folded position.

As shown in FIGS. 3 and 4, base 12 is rotatably mounted to the bottom end of vertical member 11 via a screw 18 and wing-nut 17. Base 12 has a slot 19 which accommodates the bottom end of vertical member 11 when base 12 is in the horizontal position. Slot 19 is preferably cut at an angle so that vertical member 11 tilts rearward from the vertical. Slot 19 is approximately the same width as vertical member 11, so vertical member 11 fits snugly into slot 19. In the horizontal position, wing-nut 17 is tightened and vertical member 11 is kept securely fastened to base 12 with no play or toggle occurring. If rack 10 is to be transported, wing nut 17 can be loosened and base 12 rotated to lie parallel with vertical member 11, as shown in FIG. 4. This way, the rack can be more easily transported because it can now lie flat.

Figure 5:
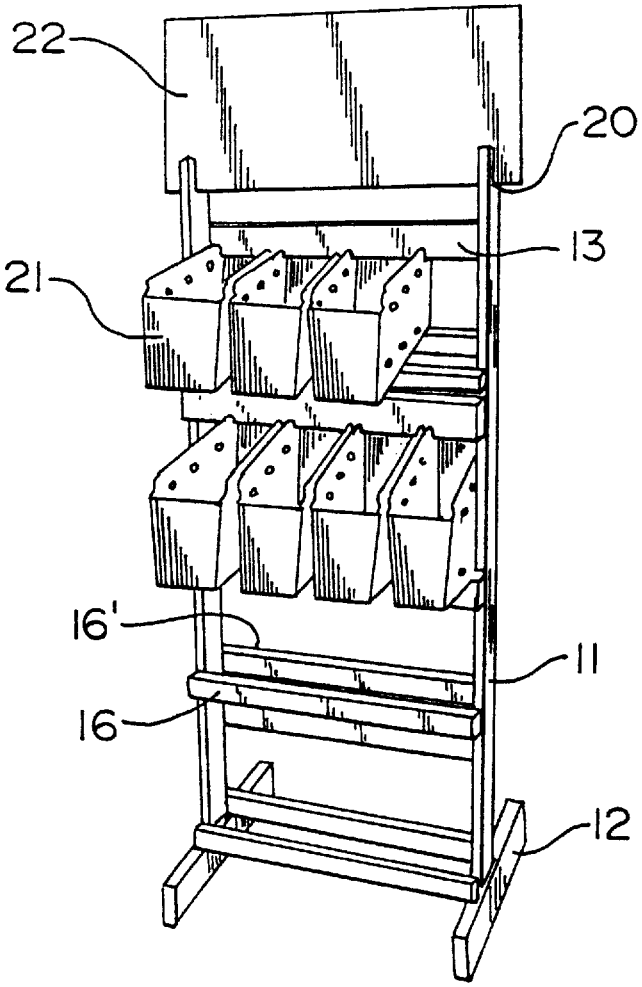
FIG. 5 shows a perspective view of the display rack according to the invention in which storage boxes and a sign are mounted.

FIG. 5 shows rack 10 as it is used to display a plurality of storage boxes 21 and hold sign 22. Storage boxes 21 can be mounted in any one of several places along rack 10 and can be easily interchanged or replaced. To mount box 21, the rear wall of box 21 is placed behind beam 15. The rear wall of box 21 then rests against the rear face of beam 15. Box 21 can be easily removed from rack 10 by lifting the bottom of box 21 up and releasing the back of box from flange 13.

The bottom of box 21 rests against bars 16 and 16' so that the front of box 21 is lower than the rear of box 21. This downward angle optimizes the display capabilities of box 21, because the contents of box 21 are more easily visible, especially when several tiers of boxes are being displayed.

Each vertical member 11 has a slit 20 through its top end, so that a sign such as sign 22 shown in FIG. 5 advertising the products displayed can be inserted.

Sign 22 can be easily replaced by simply sliding it out and inserting a different sign. Slots 20 could also be cut at an angle so that sign 22 is perfectly vertical, even though rack 10 is tilted.

Rack 10 is adapted to hold not only boxes 21 that have a wide variety of display trays or bins, which can span the entire width of rack 10. All that is required is that the tray, bin or box being mounted has rear walls that can fit behind horizontal beam 15, and have a bottom that is dimensioned to rest on bars 16 and 16'.

Accordingly, while only one embodiment of the present invention has been shown and described, it is obvious that many changes and modifications may be made thereunto without departing from the spirit and scope of the invention.

What is claimed is:

1. A display rack for displaying storage boxes for merchandise, comprising:

two spaced apart, upright members, each having a top end, a bottom end, a front side and a rear side;

two base portions each attached to the bottom end of an upright member for supporting said upright member, wherein the bottom end of said upright member fits within a slot in each base portion;

means for securing each upright member to a base portion such that the base portion may be in one of two positions, the first position being a horizontal position for stabilizing the upright members in a rearwardly-slanted position and the second position being a vertical position wherein the base portions are parallel to the upright member, wherein said means allows for rotation of the base members between the two positions;

a plurality of spaced-apart horizontal beams mounted between the two upright members, each horizontal beam being attached to the rear side of each of the two upright members, each beam having a front face; and a plurality of spaced-apart horizontal support means mounted between the two vertical members and beneath a corresponding horizontal beam, wherein the distance between each horizontal support means and the corresponding horizontal beam is approximately equal to the height of the box;

wherein the storage box can be detachably mounted on the rack by placing the rear wall of the box underneath and behind a beam so that the rear wall of the box rests against the beam, and wherein the bottom of the box rests on said support means.

2. The display rack according to claim 1, further comprising a plurality of storage boxes for mounting on the display rack, each storage box having two side walls, a bottom, a front wall, a rear wall, a predetermined width and a predetermined height, wherein the distance between each horizontal support means and the corresponding horizontal beam on the display rack is approximately equal to the height of the box, and wherein each box can be detachably mounted on the rack by placing the rear wall of the box underneath and behind a beam so that the rear wall of the box rests against the beam, and wherein the bottom of the box rests on said support means.

3. The display rack according to claim 2, wherein the support means is arranged so that one of said boxes mounted on the rack is angled slightly downward from horizontal to display merchandise contained therein.

4. The display rack according to claim 1, wherein the means for securing each base portion to a vertical member comprises a slot cut in one side of each base portion, said slot having a width equal to the width of the vertical member, a screw coupled through each vertical member and base portion, and a wing-nut for tightening the screw.

5. The display rack according to claim 1, wherein the support means comprises a pair of support bars, one bar being mounted on the front side of the vertical members and the other bar being mounted at a slightly higher height on the rear side of the vertical members.

6. The display rack according to claim 1, wherein there are four horizontal beams and four support means.

7. The display rack according to claim 1, further comprising a slit cut in the top end of each vertical member for receiving a display sign.

8. The display rack according to claim 7, wherein the slit is cut so that the display sign is perfectly vertical.

* * * * *